US006012820A

United States Patent [19]

Weber et al.

[11] Patent Number: 6,012,820

[45] Date of Patent: Jan. 11, 2000

[54] LIGHTED HAND-HOLDABLE NOVELTY ARTICLE

[75] Inventors: Michael F. Weber; Leland R. Whitney, both of St. Paul; Olester Benson, Jr., Woodbury, all of Minn.

[73] Assignee: 3M Innovative Properties Compnay, St. Paul, Minn.

[21] Appl. No.: 09/006,294

[22] Filed: Jan. 13, 1998

[51] Int. Cl.[7] ..... F21V 9/14

[52] U.S. Cl. ..... 362/19; 362/102; 362/806; 362/293; 362/253; 428/4; 446/485

[58] Field of Search ..... 362/102, 806, 362/293, 253, 186, 202, 205, 206, 19; 428/4, 5; 446/485; 40/555; 28/143, 145, 147

[56] References Cited

U.S. PATENT DOCUMENTS

| | | | |
|---|---|---|---|
| D. 331,889 | 12/1992 | Kaplan | D10/114 |
| 3,124,639 | 3/1964 | Kahn | 88/65 |
| 3,610,729 | 10/1971 | Rogers | 350/157 |
| 3,711,176 | 1/1973 | Alfrey, Jr. et al. | 350/1 |
| 3,860,036 | 1/1975 | Newman, Jr. | 138/45 |
| 4,313,843 | 2/1982 | Bollyky et al. | 252/188.3 |
| 4,446,305 | 5/1984 | Rogers et al. | 528/348 |
| 4,520,189 | 5/1985 | Rogers et al. | 528/331 |
| 4,521,588 | 6/1985 | Rogers et al. | 528/363 |
| 4,525,413 | 6/1985 | Rogers et al. | 428/212 |
| 4,678,608 | 7/1987 | Dugliss | 252/700 |
| 4,717,511 | 1/1988 | Koroseil | 252/700 |
| 4,720,426 | 1/1988 | Englert et al. | 428/344 |
| 4,797,308 | 1/1989 | Mattin | 428/15 |
| 4,886,687 | 12/1989 | Malott | 428/4 |
| 4,967,321 | 10/1990 | Cimock . | |
| 5,037,346 | 8/1991 | Cimock | 446/419 |
| 5,043,851 | 8/1991 | Kaplan | 362/34 |
| 5,122,306 | 6/1992 | Van Moer et al. | 252/700 |
| 5,165,781 | 11/1992 | Orak | 362/186 |
| 5,188,760 | 2/1993 | Hikmet et al. | 252/299.01 |
| 5,211,878 | 5/1993 | Reiffenrath et al. | 252/299.63 |
| 5,232,635 | 8/1993 | Van Moer et al. | 252/700 |
| 5,235,443 | 8/1993 | Barnik et al. | 359/37 |
| 5,269,995 | 12/1993 | Ramanathan et al. | 264/171 |
| 5,279,513 | 1/1994 | Connelly | 446/219 |
| 5,294,657 | 3/1994 | Melendy et al. | 524/270 |
| 5,316,703 | 5/1994 | Schrenk | 264/1.3 |
| 5,319,478 | 6/1994 | Fijnfschilling et al. | 359/53 |
| 5,389,324 | 2/1995 | Lewis et al. | 264/171 |
| 5,422,756 | 6/1995 | Weber | 362/19 |
| 5,448,404 | 9/1995 | Schrenk et al. | 359/584 |
| 5,451,449 | 9/1995 | Shetty et al. | 428/195 |

(List continued on next page.)

FOREIGN PATENT DOCUMENTS

| | | |
|---|---|---|
| 469964 | 12/1928 | Germany . |
| WO 95/27919 | 4/1995 | WIPO . |
| WO 95/17303 | 6/1995 | WIPO . |
| WO 95/17691 | 6/1995 | WIPO . |
| WO 95/17692 | 6/1995 | WIPO . |
| WO 95/17699 | 6/1995 | WIPO . |
| WO 96/19347 | 6/1996 | WIPO . |
| WO 97/01440 | 1/1997 | WIPO . |
| WO 97/01774 | 1/1997 | WIPO . |
| WO 97/32226 | 9/1997 | WIPO . |

OTHER PUBLICATIONS

Schrenk et al., Nanolayer polymeric optical films, Tappi Journal, pp. 169–174, Jun., 1992.

U.S. Ser. No. 09/006,088, filed Jan. 13, 1998, entitled "Hand–Holdable Toy Light Tube".

(List continued on next page.)

*Primary Examiner*—Thomas M. Sember
*Attorney, Agent, or Firm*—Gregory D. Allen

[57] ABSTRACT

Hand-holdable novelty article comprising a handle, a light source and a plurality of sections of color shifting film. The light source is preferably disposed within an end of the handle. The plurality of sections of color shifting film extend from the end of the handle. During use, light from the light source interacts with the plurality of strands of color shifting film, producing a brilliant colored effect. Movement of the plurality of sections of color shifting film produces multiple colors.

32 Claims, 5 Drawing Sheets

U.S. PATENT DOCUMENTS

| | | | |
|---|---|---|---|
| 5,486,935 | 1/1996 | Kalmanash | 359/37 |
| 5,486,949 | 1/1996 | Schrenk et al. | 359/498 |
| 5,576,089 | 11/1996 | Weder | 428/142 |
| 5,612,820 | 3/1997 | Schrenk et al. | 359/498 |
| 5,629,055 | 5/1997 | Revol et al. | 428/1 |
| 5,642,931 | 7/1997 | Gappelberg | 362/186 |
| 5,686,979 | 11/1997 | Weber et al. | 349/96 |
| 5,699,188 | 12/1997 | Gilbert et al. | 359/584 |
| 5,701,720 | 12/1997 | Weder | 53/397 |
| 5,707,915 | 1/1998 | Taoda | 502/159 |
| 5,721,603 | 2/1998 | De Vaan et al. | 349/194 |
| 5,744,534 | 4/1998 | Ishiharada et al. | 524/442 |
| 5,751,388 | 5/1998 | Larson | 349/96 |
| 5,767,935 | 6/1998 | Ueda et al. | 349/112 |
| 5,770,306 | 6/1998 | Suzuki et al. | 428/328 |
| 5,783,120 | 7/1998 | Ouderkirk et al. | 264/134 |
| 5,793,456 | 8/1998 | Broer et al. | 349/98 |
| 5,808,794 | 9/1998 | Weber et al. | 359/487 |
| 5,825,542 | 10/1998 | Cobb, Jr. et al. | 359/487 |
| 5,825,543 | 10/1998 | Ouderkirk et al. | 359/494 |
| 5,828,488 | 10/1998 | Ouderkirk | 362/19 |

OTHER PUBLICATIONS

U.S. Ser. No. 09/006,591, filed Jan. 13, 1998, entitled "Color Shifting Film".

U.S. Ser. No. 09/006,118 filed Jan. 13, 1998, entitled "Multicomponent Optical Body".

U.S. Ser. No. 09/006,288, filed Jan. 13, 1998, entitled "Process For Making Multilayer Optical Films".

U.S. Ser. No. 08/402,041, filed Mar. 10, 1995, entitled "Optical Film".

U.S. Ser. No. 08/494,366, filed Jun. 26, 1995, entitled "High Efficiency Optical Devices".

U.S. Ser. No. 09/006,601, filed Jan. 13, 1998, entitled "Modified Copolyesters And Improved Multilayer Reflective Films".

Snaplight® Lite–Up Lightstick product wrapper, Green color, Omniglow Corp., Portmouth, NH, UPC 41696 90756, date unknown, purchased in 1997.

Coleman for Kids Rugged Outdoor Gear, Illumisticks product packaging, UPC 76501 91467, date unknown, at least 1997, the Coleman Company, Inc.

Letter from Engehard Corporation dated Apr. 11, 1997.

Mearl Corporation Product Information entitled "Mearl Iridescent Films, General Information, Sheet No. TIB–C", 6 pages, at least Apr. 11, 1997.

Mearl Corporation Product Information entitled "Mearl Standard Iridescent Films, Product Comparison Charts, Applications, and Properties", 4 pages, Oct. 1992.

ChromaFlair® Light Interference Pigments Product Brochure, Flex Products, Inc. at least 1997.

ChromaFlair® Light Interference Pigments Product Brochure Packet (consisting of a folder with an 8 page insert, and a 6 page document entitled Commonly Asked Questions (Apr. 1997) and a seventh page entitled ChromaFlair® Preliminary Technical Data Sheet (Apr. 1997), at least 1997.

LIGHTED HAND-HOLDABLE NOVELTY ARTICLE

FIELD OF THE INVENTION

The present invention relates to hand-holdable novelty articles, such as a pom-pon. More particularly, it relates to a hand-holdable novelty article incorporating a light source and color shifting film.

BACKGROUND OF THE INVENTION

Hand-holdable fireworks are often found at various outdoor events, ranging from large national holiday festivals to small gatherings around a campfire. One typically used firework at such events is a hand-holdable sparkler.

Generally, a "sparkler" is a firework that throws off brilliant sparks upon burning. Conventional sparklers typically are comprised of a relatively long stick with a flammable compound (e.g., phosphorous) coated thereon. During use, the leading end of the coated stick is ignited (e.g., with a match or lighter). The user grasps the stick at an opposite end. The flammable coating slowly burns for a few minutes, randomly emitting bright white or other colored sparks.

Many people, including children, are highly attracted to and enjoy using or otherwise viewing sparklers. The use, including misuse, of sparklers has led to numerous injuries to both users and viewers. For example, the random sparks from the sparkler may contact the skin or eyes, resulting in minor or severe injuries. Such injuries may be more frequent when the sparkler is rapidly moved, for example, by the user swinging his or her arm and/or running with the sparkler to enhance the visual effect.

Such dangers associated with the use of sparklers are a concern to many, including parents or guardians of children. Unfortunately, the available alternative products, while generally safer, lack one or more of the effects provided by sparklers. For example, hand-holdable pom-pons that include a number of paper or paper-like (e.g., plastic) strands attached to a handle are known. Although the paper strands are frequently made of numerous colors, they cannot be seen in the dark and do not produce the brilliant white or multi-color glowing appearance of a sparkler.

More recently, fluorescent-colored cylinders (see, e.g., U.S. Pat. Nos. 4,678,608 (Dugliss); 4,717,511 (Koroseil); 5,043,851 (Kaplan); 5,122,306 (Van Moer et al.); and 5,232,635 (Van Moer et al.) and U.S. Design Pat. No. 331,889 (Kaplan)) have been developed as a possible alternative to sparklers. Such cylinders are commonly comprised of a flexible plastic outer tube and a brittle inner tube. A first liquid is maintained with the inner tube and a second liquid between the outer tube and the inner tube. When the cylinder is bent, the inner tube breaks, allowing the two liquids to mix. Such novelty articles are available, for example, from the Coleman Company, Inc. of Kansas under the trade designation "ILLUMINISTICKS", and from Ominglow Corp. of Portmouth, N.H. under the trade designation "SNAPLIGHT". The resulting mixture produces a "glowing" effect. While viewable in the dark, this product does not reproduce the effects of random sparks. Incidentally, like a sparkler, such glowing cylinders are a one-use product (i.e., once the liquids are mixed, the cylinder will glow for a period of time, but cannot be reactivated).

Toy and other novelty article manufacturers are continually attempting to produce hand-holdable entertainment devices which function in the dark. Further, many children and adults alike desire to purchase and use such products. Although there are several alternatives to sparklers, a need for other alternatives, preferably ones that more closely resemble the visual effects offered by sparklers, are needed.

SUMMARY OF THE INVENTION

The present invention provides a hand-holdable novelty article comprising a handle (including a first end), and a plurality of sections of color shifting film extending from the first end, and a light source (i.e., the article includes a source that generates light as opposed to one that merely reflects ambient light) connected to (including within) the handle, wherein the light source is configured to be activated by a power source. Preferably, the light source is disposed at the first end of the handle. In another aspect, the light source is preferably a point light source (e.g., a flashlight). When energized or activated, the light source illuminates at least a portion of the plurality of sections of color shifting film. Optionally, the article includes a power source electrically coupled to the light source in conjunction with a switch to control activation of the light source.

The color shifting film utilized in the present invention comprises alternating layers of at least a first and second polymeric material, wherein at least one of the first or second polymeric materials is birefringent, wherein the difference in indices of refraction of the first and second polymeric materials for visible light polarized along first and second axes in the plane of the layers is at least about 0.05, and wherein the difference in indices of refraction of the first and second polymeric materials for visible light polarized along a third axis mutually orthogonal to the first and second axes is less than about 0.05. Preferably, the color shifting film has at least one transmission band in the visible region of the spectrum and at least one reflection band (preferably having a peak reflectivity of at least about 70%, more preferably, at least 85%, even more preferably, at least 95%) in the visible region of the spectrum.

In another aspect, preferably at least one of the first or second polymeric materials of the color shifting film is positively or negatively birefringent. In another aspect, preferably the difference in indices of refraction of the first and second polymeric materials for visible light polarized along first and second axes in the plane of the layers is $\Delta x$ and $\Delta y$, respectively, wherein the difference in indices of refraction of the first and second polymeric materials for visible light polarized along a third axis mutually orthogonal to the first and second axes is $\Delta z$, and wherein the absolute value of $\Delta z$ is less than about one half (in some embodiments one quarter, or even one tenth) the larger of the absolute value of $\Delta x$ and the absolute value of $\Delta y$.

Further with regard to the color shifting film, at least one of the first and second materials can be a strain hardening polyester (e.g., a naphthalene dicarboxylic acid polyester or a methacrylic acid polyester). In other aspect, the first polymeric material can be polyethylene naphthalate and the second polymeric material polymethylmethacrylate.

In one preferred embodiment according to the present invention, the plurality of sections of color shifting film are flexible strands configured to resemble a pom-pon. Further, a preferred embodiment includes at least twenty strands, more preferably, at least 30, 40, 50 or more strands. During use, each of the plurality of strands can be rapidly displaced with movement of the handle, producing a multi-colored effect.

Certain preferred color shifting films used in the present invention are advantageous over prior art color films in many respects. For example, while color shifting films based on isotropic materials are known, these preferred films exhibit decreased reflectivities at non-normal angles of incidence, which diminishes the intensity of the reflected wavelengths at non-normal angles of incidence. Hence, such films appear lighter and have less saturated colors at oblique angles. Other color shifting films change their spectral profile as a function of angle, resulting in diminished color purity and/or less dramatic color shifts with angle.

BRIEF DESCRIPTION OF THE DRAWING

The accompanying drawing is included to provide a further understanding of the present invention and are incorporated in and constitute a part of this specification. The drawing illustrates exemplary embodiments of the present invention and together with the description serve to further explain the principles of the invention. Other aspects of the present invention and many of the attendant advantages of the present invention will be readily appreciated as the same becomes better understood by reference to the following Detailed Description when considered in connection with the accompanying drawing, and wherein.

DETAILED DESCRIPTION

Figure 1:
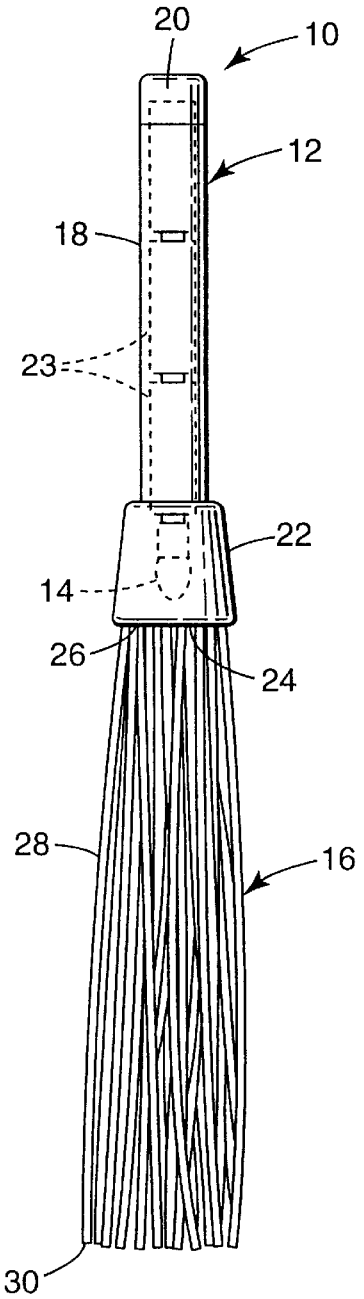
FIG. 1 is a side view of a hand-holdable novelty article according to the present invention.

Referring to FIG. 1, exemplary hand-holdable novelty article according to the present invention 10 includes handle 12, light source 14, and plurality of sections of color shifting film 16. Handle 12 has body 18 and ends 20 and 22. Light source 14 is connected to the handle and is configured to be powered by power source 23 (e.g., battery shown in dashed lines), and is disposed at end 22 of handle 12. Plurality of sections of color shifting film 16 extend from end 22 of handle 12.

Plurality of sections of color shifting film 16 can be arranged in a number of different manners. Activation of light source 14 directs light onto at least a portion of the plurality of sections of color shifting film. Plurality of sections of color shifting film 16 interact with light from light source 14, producing a visual (e.g., brightly colored) effect.

In one preferred embodiment, hand-holdable novelty article 10 resembles a pom-pon. Body 18 is preferably hollow to maintain power source such as battery 23 for powering light source 14. Further, end 20 is preferably threadably secured to body 18, and end 22 is preferably rotatably secured to body 18.

End 22 is preferably configured to receive and maintain light source 14. Further, end 22 preferably includes translucent or filtered leading edge 24 (e.g., a clear lens) through which light from light source 14 can pass. In this regard, end 22 is configured to direct light from light source 14 to leading edge 24.

In one preferred embodiment, handle 12 is, or is similar to, a flashlight wherein, for example, body 18 and ends 20, 22 can be manufactured separately, but are configured for integral attachment. In this regard, end 20 can be threadably secured to body 18 to maintain power source 23 within body 18. End 22 is preferably rotatably secured to body 18 and acts as a switch operably connected between power source 23 and light source 14. That is, rotation of end 22 relative to body 18 moves light source 14 into and out of contact with power source 23. Alternatively, for example, end 22 can be permanently secured to body 18 and an additional finger-operated switch can be disposed along an outer circumference of body 18 for activating light source 14.

Components of the hand-holdable article according to the present invention can be made of any suitable material, including those disclosed herein, although some materials may be more suitable than others depending on the particular article use, all the color shifting film material is as defined herein. For example, suitable materials for the handle may include rigid material (e.g., hard plastic, aluminum, stainless steel, or wood) or non-rigid materials such as rubber.

Regardless of the type of radiation, the term "illuminate" is used herein to indicate that the color shifting film is exposed to the radiation emitted from the light source. The light source can be, for example, electrical and/or chemical (e.g., chemiluminescent (see, e.g., U.S. Pat. Nos. 4,717,511 (Koroscil), 5,043,851 (Kaplan), and 5,232,635 (Van Moer et al.), the disclosures of which are incorporated herein by reference)). Preferably, the light source emits visible (i.e., electromagnetic radiation having one or more wavelengths in the range from about $4\times10^{-7}$ m to $7\times10^{-7}$ m) and/or UV radiation (i.e., electromagnetic radiation having one or more wavelengths in the range from about $6\times10^{-8}$ m to $4\times10^{-7}$ m), although for some uses (e.g., photographic or electronic recording), other wavelength of radiation compatible with the recording media or recording sensor may also be useful. Further, it is understood that one skilled in the art would select a light source(s) for emitting the wavelength(s) of light and a color shifting film(s), which provide a desired visible effect.

The light source is preferably an incandescent light bulb, although other light sources such as a black light lamp, a halogen lamp, or light emitting diode can also be used. The light source may include a plurality of lamps. Even further, for example, the light source can be configured to have a spikey spectral distribution. Preferably the light source emits radiation toward plurality of sections of color shifting film. Preferred light sources, which also include handles, are flashlights (including those marketed by MAG Instruments of Ontario, Canada under the trade designation "MAGLIGHT").

Color shifting films used in the present invention include those described in U.S. Ser. No. 09/006,591, filed Jan. 13, 1998, the disclosure of which is incorporated herein by reference. These color shifting films are multilayer birefringent polymeric films having particular relationships between the refractive indices of successive layers for light polarized along mutually orthogonal in-plane axes (the x-axis and the y-axis) and along an axis perpendicular to the in-plane axes (the z-axis). In particular, the differences in refractive indices along the x-, y-, and z-axes ($\Delta x$, $\Delta y$, and $\Delta z$, respectively) are such that the absolute value of $\Delta z$ is less than about one half (in some embodiments one quarter or even one tenth) the larger of the absolute value of $\Delta x$ and the absolute value of $\Delta y$ (e.g., ($|\Delta z|<0.5$ k (in some embodiments 0.25 k or even 0.1 k), $k=\max\{|\Delta x|, |\Delta y|\}$)). Films having this property can be made to exhibit transmission spectra in which the widths and intensities of the transmission or reflection peaks (when plotted as a function of frequency, or $1/\lambda$) for p-polarized light remain essentially constant over a wide range of viewing angles, but shift in wavelength as a function of angle. Also for p-polarized light, the spectral features shift toward the blue region of the spectrum at a higher rate with angle change than the spectral features of isotropic thin film stacks. In some embodiments, these color shifting films have at least one optical stack in which the optical thicknesses of the individual layers change monotonically in one direction (e.g., increasing or decreasing) over a first portion of the stack, and then change monotonically in a different direction or remain constant over at least a second portion of the stack. Color shifting films having stack designs of this type exhibit a sharp band edge at one or both sides of the reflection band(s), causing the film to exhibit sharp, eye-catching color changes as a function of viewing angle.

Further, color shifting films can be regarded as special cases of mirror and polarizing (optical) films. Various process considerations are important in making high quality optical films and other optical devices in accordance with the present invention. Such optical films include, but are not limited to polarizers, mirrors, colored films, and combinations thereof, which are optically effective over diverse portions of the ultraviolet, visible, and infrared spectra. The process conditions used to make each film will depend in part on the particular resin system used and the desired optical properties of the final film. The following description is intended as an overview of those process considerations common to many resin systems used in making the coextruded optical films useful for the present invention.

Material Selection

Regarding the materials from which the films are to be made, there are several conditions which must be met that are common to certain preferred multilayer optical films for use in the present invention. First, these films comprise at least two distinguishable polymers. The number is not limited, and three or more polymers may be advantageously used in particular films. Second, one of the two required polymers, referred to as the "first polymer", must have a stress optical coefficient having a large absolute value. In other words, it must be capable of developing a large birefringence when stretched. Depending on the application, this birefringence may be developed between two orthogonal directions in the plane of the film, between one or more in-plane directions and the direction perpendicular to the film plane, or a combination of these. Third, the first polymer must be capable of maintaining this birefringence after stretching, so that the desired optical properties are imparted to the finished film. Fourth, the other required polymer, referred to as the "second polymer", must be chosen so that in the finished film, its refractive index, in at least one direction, differs significantly from the index of refraction of the first polymer in the same direction. Because polymeric materials are dispersive, that is, the refractive indices vary with wavelength, these conditions must be considered in terms of a spectral bandwidth of interest.

Other aspects of polymer selection depend on specific applications. For polarizing films, it is advantageous for the difference in the index of refraction of the first and second polymers in one film-plane direction to differ significantly in the finished film, while the difference in the orthogonal film-plane index is minimized. If the first polymer has a large refractive index when isotropic, and is positively birefringent (that is, its refractive index increases in the direction of stretching), the second polymer will be chosen to have a matching refractive index, after processing, in the planar direction orthogonal to the stretching direction, and a refractive index in the direction of stretching which is as low as possible. Conversely, if the first polymer has a small refractive index when isotropic, and is negatively birefringent, the second polymer will be chosen to have a matching refractive index, after processing, in the planar direction orthogonal to the stretching direction, and a refractive index in the direction of stretching which is as high as possible.

Alternatively, it is possible to select a first polymer which is positively birefringent and has an intermediate or low refractive index when isotropic, or one which is negatively birefringent and has an intermediate or high refractive index when isotropic. In these cases, the second polymer may be chosen so that, after processing, its refractive index will match that of the first polymer in either the stretching direction or the planar direction orthogonal to stretching. Further, the second polymer will be chosen such that the difference in index of refraction in the remaining planar direction is maximized, regardless of whether this is best accomplished by a very low or very high index of refraction in that direction.

One means of achieving this combination of planar index matching in one direction and mismatching in the orthogonal direction is to select a first polymer which develops significant birefringence when stretched, and a second polymer which develops little or no birefringence when stretched, and to stretch the resulting film in only one planar direction. Alternatively, the second polymer may be selected from among those which develop birefringence in the sense opposite to that of the first polymer (negative–positive or positive–negative). Another alternative method is to select both first and second polymers which are capable of developing birefringence when stretched, but to stretch in two orthogonal planar directions, selecting process conditions, such as temperatures, stretch rates, post-stretch relaxation, and the like, which result in development of unequal levels of orientation in the two stretching directions for the first polymer, and levels of orientation for the second polymer such that one in-plane index is approximately matched to that of the first polymer, and the orthogonal in-plane index is significantly mismatched to that of the first polymer. For example, conditions may be chosen such that the first polymer has a biaxially oriented character in the finished film, while the second polymer has a predominantly uniaxially oriented character in the finished film.

The foregoing is meant to be exemplary, and it will be understood that combinations of these and other techniques may be employed to achieve the polarizing film goal of index mismatch in one in-plane direction and relative index matching in the orthogonal planar direction.

Different considerations apply to a reflective, or mirror, film. Provided that the film is not meant to have some polarizing properties as well, refractive index criteria apply equally to any direction in the film plane, so it is typical for the indices for any given layer in orthogonal in-plane directions to be equal or nearly so. It is advantageous, however, for the film-plane indices of the first polymer to differ as greatly as possible from the film-plane indices of the second polymer. For this reason, if the first polymer has a high index of refraction when isotropic, it is advantageous that it also be positively birefringent. Likewise, if the first polymer has a low index of refraction when isotropic, it is advantageous that it also be negatively birefringent. The second polymer advantageously develops little or no birefringence when stretched, or develops birefringence of the opposite sense (positive–negative or negative–positive), such that its film-plane refractive indices differ as much as possible from those of the first polymer in the finished film. These criteria may be combined appropriately with those listed above for polarizing films if a mirror film is meant to have some degree of polarizing properties as well.

As mentioned above, color shifting films can be regarded as special cases of mirror and polarizing films. Thus, the same criteria outlined above apply. The perceived color is a result of reflection or polarization over one or more specific bandwidths of the spectrum. The bandwidths over which a multilayer film of the current invention is effective will be determined primarily by the distribution of layer thicknesses employed in the optical stack(s), but consideration must also be given to the wavelength dependence, or dispersion, of the refractive indices of the first and second polymers. It will be understood that the same rules apply to the infrared and ultraviolet wavelengths as to the visible colors.

Absorbance is another consideration. For most applications, it is advantageous for neither the first polymer nor the second polymer to have any absorbance bands within the bandwidth of interest for the film in question. Thus, all incident light within the bandwidth is either reflected or transmitted. However, for some applications, it may be useful for one or both of the first and second polymer to absorb specific wavelengths, either totally or in part.

Polyethylene 2,6-naphthalate (PEN) is frequently chosen as a first polymer for films of the present invention. It has a large positive stress optical coefficient, retains birefringence effectively after stretching, and has little or no absorbance within the visible range. It also has a large index of refraction in the isotropic state. Its refractive index for polarized incident light of 550 nm wavelength increases when the plane of polarization is parallel to the stretch direction from about 1.64 to as high as about 1.9. Its birefringence can be increased by increasing its molecular orientation which, in turn, may be increased by stretching to greater stretch ratios with other stretching conditions held fixed.

Other semicrystalline naphthalene dicarboxylic polyesters are also suitable as first polymers. Polybutylene 2,6-Naphthalate (PBN) is an example. These polymers may be homopolymers or copolymers, provided that the use of comonomers does not substantially impair the stress optical coefficient or retention of birefringence after stretching. The term "PEN" herein will be understood to include copolymers of PEN meeting these restrictions. In practice, these restrictions imposes an upper limit on the comonomer content, the exact value of which will vary with the choice of comonomer(s) employed. Some compromise in these properties may be accepted, however, if comonomer incorporation results in improvement of other properties. Such properties include but are not limited to improved interlayer adhesion, lower melting point (resulting in lower extrusion temperature), better rheological matching to other polymers in the film, and advantageous shifts in the process window for stretching due to change in the glass transition temperature.

Suitable comonomers for use in PEN, PBN or the like may be of the diol or dicarboxylic acid or ester type. Dicarboxylic acid comonomers include but are not limited to terephthalic acid, isophthalic acid, phthalic acid, all isomeric naphthalenedicarboxylic acids (2,6-, 1,2-, 1,3-, 1,4-, 1,5-, 1,6-, 1,7-, 1,8-, 2,3-, 2,4-, 2,5-, 2,7-, and 2,8-), bibenzoic acids such as 4,4'-biphenyl dicarboxylic acid and its isomers, trans-4,4'-stilbene dicarboxylic acid and its isomers, 4,4'-diphenyl ether dicarboxylic acid and its isomers, 4,4'-diphenylsulfone dicarboxylic acid and its isomers, 4,4'-benzophenone dicarboxylic acid and its isomers, halogenated aromatic dicarboxylic acids such as 2-chloroterephthalic acid and 2,5-dichloroterephthalic acid, other substituted aromatic dicarboxylic acids such as tertiary butyl isophthalic acid and sodium sulfonated isophthalic acid, cycloalkane dicarboxylic acids such as 1,4-cyclohexanedicarboxylic acid and its isomers and 2,6-decahydronaphthalene dicarboxylic acid and its isomers, bi- or multi-cyclic dicarboxylic acids (such as the various isomeric norbornane and norbornene dicarboxylic acids, adamantane dicarboxylic acids, and bicyclo-octane dicarboxylic acids), alkane dicarboxylic acids (such as sebacic acid, adipic acid, oxalic acid, malonic acid, succinic acid, glutaric acid, azelaic acid, and dodecane dicarboxylic acid.), and any of the isomeric dicarboxylic acids of the fused-ring aromatic hydrocarbons (such as indene, anthracene, pheneanthrene, benzonaphthene, fluorene and the like). Alternatively, alkyl esters of these monomers, such as dimethyl terephthalate, may be used.

Suitable diol comonomers include but are not limited to linear or branched alkane diols or glycols (such as ethylene glycol, propanediols such as trimethylene glycol, butanediols such as tetramethylene glycol, pentanediols such as neopentyl glycol, hexanediols, 2,2,4-trimethyl-1,3-pentanediol and higher diols), ether glycols (such as diethylene glycol, triethylene glycol, and polyethylene glycol), chain-ester diols such as 3-hydroxy-2,2-dimethylpropyl-3-hydroxy-2,2-dimethyl propanoate, cycloalkane glycols such as 1,4-cyclohexanedimethanol and its isomers and 1,4-cyclohexanediol and its isomers, bi- or multicyclic diols (such as the various isomeric tricyclodecane dimethanols, norbomane dimethanols, norbornene dimethanols, and bicyclo-octane dimethanols), aromatic glycols (such as 1,4-benzenedimethanol and its isomers, 1,4-benzenediol and its isomers, bisphenols such as bisphenol A, 2,2'-dihydroxy biphenyl and its isomers, 4,4'-dihydroxymethyl biphenyl and its isomers, and 1,3-bis(2-hydroxyethoxy)benzene and its isomers), and lower alkyl ethers or diethers of these diols, such as dimethyl or diethyl diols.

Tri- or polyfunctional comonomers, which can serve to impart a branched structure to the polyester molecules, can also be used. They may be of either the carboxylic acid, ester, hydroxy or ether types. Examples include, but are not limited to, trimellitic acid and its esters, trimethylol propane, and pentaerythritol.

Also suitable as comonomers are monomers of mixed functionality, including hydroxycarboxylic acids such as parahydroxybenzoic acid and 6-hydroxy-2-naphthalenecarboxylic acid, and their isomers, and tri- or polyfunctional comonomers of mixed functionality such as 5-hydroxyisophthalic acid and the like.

Polyethylene terephthalate (PET) is another material that exhibits a significant positive stress optical coefficient, retains birefringence effectively after stretching, and has little or no absorbance within the visible range. Thus, it and its high PET-content copolymers employing comonomers listed above may also be used as first polymers in some applications of the current invention.

When a naphthalene dicarboxylic polyester such as PEN or PBN is chosen as first polymer, there are several approaches which may be taken to the selection of a second polymer. One preferred approach for some applications is to select a naphthalene dicarboxylic copolyester (coPEN) formulated so as to develop significantly less or no birefringence when stretched. This can be accomplished by choosing comonomers and their concentrations in the copolymer such that crystallizability of the coPEN is eliminated or greatly reduced. One typical formulation employs as the dicarboxylic acid or ester components dimethyl naphthalate at from about 20 mole percent to about 80 mole percent and dimethyl terephthalate or dimethyl isophthalate at from about 20 mole percent to about 80 mole percent, and employs ethylene glycol as diol component. Of course, the corresponding dicarboxylic acids may be used instead of the esters. The number of comonomers which can be employed in the formulation of a coPEN second polymer is not limited. Suitable comonomers for a coPEN second polymer include but are not limited to all of the comonomers listed above as suitable PEN comonomers, including the acid, ester, hydroxy, ether, tri- or polyfunctional, and mixed functionality types.

Often it is useful to predict the isotropic refractive index of a coPEN second polymer. A volume average of the refractive indices of the monomers to be employed has been found to be a suitable guide. Similar techniques well-known in the art can be used to estimate glass transition temperatures for coPEN second polymers from the glass transitions of the homopolymers of the monomers to be employed.

In addition, polycarbonates having a glass transition temperature compatible with that of PEN and having a refractive index similar to the isotropic refractive index of PEN are also useful as second polymers. Polyesters, copolyesters, polycarbonates, and copolycarbonates may also be fed together to an extruder and transesterified into new suitable copolymeric second polymers.

It is not required that the second polymer be a copolyester or copolycarbonate. Vinyl polymers and copolymers made from monomers such as vinyl naphthalenes, styrenes, ethylene, maleic anhydride, acrylates, acetates, and methacrylates may be employed. Condensation polymers other than polyesters and polycarbonates may also be used. Examples include: polysulfones, polyamides, polyurethanes, polyamic acids, and polyimides. Naphthalene groups and halogens such as chlorine, bromine and iodine are useful for increasing the refractive index of the second polymer to a desired level. Acrylate groups and fluorine are particularly useful in decreasing refractive index when this is desired.

It will be understood from the foregoing discussion that the choice of a second polymer is dependent not only on the intended application of the multilayer optical film in question, but also on the choice made for the first polymer, and the processing conditions employed in stretching. Suitable second polymer materials include but are not limited to polyethylene naphthalate (PEN) and isomers thereof (such as 2,6-, 1,4-, 1,5-, 2,7-, and 2,3-PEN), polyalkylene terephthalates (such as polyethylene terephthalate, polybutylene terephthalate, and poly-1,4-cyclohexanedimethylene terephthalate), other polyesters, polycarbonates, polyarylates, polyamides (such as nylon 6, nylon 11, nylon 12, nylon 4/6, nylon 6/6, nylon 6/9, nylon 6/10, nylon 6/12, and nylon 6/T), polyimides (including thermoplastic polyimides and polyacrylic imides), polyamide-imides, polyether-amides, polyetherimides, polyaryl ethers (such as polyphenylene ether and the ring-substituted polyphenylene oxides), polyarylether ketones such as polyetheretherketone ("PEEK"), aliphatic polyketones (such as copolymers and terpolymers of ethylene and/or propylene with carbon dioxide), polyphenylene sulfide, polysulfones (including polyethersulfones and polyaryl sulfones), atactic polystyrene, syndiotactic polystyrene ("sPS") and its derivatives (such as syndiotactic poly-alpha-methyl styrene and syndiotactic polydichlorostyrene), blends of any of these polystyrenes (with each other or with other polymers, such as polyphenylene oxides), copolymers of any of these polystyrenes (such as styrene-butadiene copolymers, styrene-acrylonitrile copolymers, and acrylonitrile-butadiene-styrene terpolymers), polyacrylates (such as polymethyl acrylate, polyethyl acrylate, and polybutyl acrylate), polymethacrylates (such as polymethyl methacrylate, polyethyl methacrylate, polypropyl methacrylate, and polyisobutyl methacrylate), cellulose derivatives (such as ethyl cellulose, cellulose acetate, cellulose propionate, cellulose acetate butyrate, and cellulose nitrate), polyalkylene polymers (such as polyethylene, polypropylene, polybutylene, polyisobutylene, and poly(4-methyl)pentene), fluorinated polymers and copolymers (such as polytetrafluoroethylene, polytrifluoroethylene, polyvinylidene fluoride, polyvinyl fluoride, fluorinated ethylene-propylene copolymers, perfluoroalkoxy resins, polychlorotrifluoroethylene, polyethylene-co-trifluoroethylene, polyethylene-co-chlorotrifluoroethylene), chlorinated polymers (such as polyvinylidene chloride and polyvinyl chloride), polyacrylonitrile, polyvinylacetate, polyethers (such as polyoxymethylene and polyethylene oxide), ionomeric resins, elastomers (such as polybutadiene, polyisoprene, and neoprene), silicone resins, epoxy resins, and polyurethanes.

Also suitable are copolymers, such as the copolymers of PEN discussed above as well as any other non-naphthalene group-containing copolyesters which may be formulated from the above lists of suitable polyester comonomers for PEN. In some applications, especially when PET serves as the first polymer, copolyesters based on PET and comonomers from the lists above (coPETs) are especially suitable. In addition, either first or second polymers may consist of miscible or immiscible blends of two or more of the above-described polymers or copolymers (such as blends of sPS and atactic polystyrene, or of PEN and sPS). The coPENs and coPETs described may be synthesized directly, or may be formulated as a blend of pellets where at least one component is a polymer based on naphthalene dicarboxylic acid or terephthalic acid and other components are polycarbonates or other polyesters, such as a PET, a PEN, a coPET, or a co-PEN.

Another preferred family of materials for the second polymer for some applications are the syndiotactic vinyl aromatic polymers, such as syndiotactic polystyrene. Syndiotactic vinyl aromatic polymers useful in the current invention include poly(styrene), poly(alkyl styrene)s, poly(aryl styrene)s, poly(styrene halide)s, poly(alkoxy styrene)s, poly(vinyl ester benzoate), poly(vinyl naphthalene), poly(vinylstyrene), and poly(acenaphthalene), as well as the hydrogenated polymers and mixtures or copolymers containing these structural units. Examples of poly(alkyl styrene)s include the isomers of the following: poly(methyl styrene), poly(ethyl styrene), poly(propyl styrene), and poly(butyl styrene). Examples of poly(aryl styrene)s include the isomers of poly(phenyl styrene). As for the poly(styrene halide)s, examples include the isomers of the following: poly(chlorostyrene), poly(bromostyrene), and poly(fluorostyrene). Examples of poly(alkoxy styrene)s include the isomers of the following: poly(methoxy styrene) and poly(ethoxy styrene). Among these examples, particularly preferable styrene group polymers, are: polystyrene, poly(p-methyl styrene), poly(m-methyl styrene), poly(p-tertiary butyl styrene), poly(p-chlorostyrene), poly(m-chloro styrene), poly(p-fluoro styrene), and copolymers of styrene and p-methyl styrene.

Furthermore, comonomers may be used to make syndiotactic vinyl aromatic group copolymers. In addition to the monomers for the homopolymers listed above in defining the syndiotactic vinyl aromatic polymers group, suitable comonomers include olefin monomers (such as ethylene, propylene, butenes, pentenes, hexenes, octenes or decenes), diene monomers (such as butadiene and isoprene), and polar vinyl monomers (such as cyclic diene monomers, methyl methacrylate, maleic acid anhydride, or acrylonitrile).

The syndiotactic vinyl aromatic copolymers of the present invention may be block copolymers, random copolymers, or alternating copolymers.

The syndiotactic vinyl aromatic polymers and copolymers referred to in this invention generally have syndiotacticity of higher than 75% or more, as determined by carbon-13 nuclear magnetic resonance. Preferably, the degree of syndiotacticity is higher than 85% racemic diad, or higher than 30%, or more preferably, higher than 50%, racemic pentad.

In addition, although there are no particular restrictions regarding the molecular weight of these syndiotactic vinyl aromatic polymers and copolymers, preferably, the weight average molecular weight is greater than 10,000 and less than 1,000,000, and more preferably, greater than 50,000 and less than 800,000.

The syndiotactic vinyl aromatic polymers and copolymers may also be used in the form of polymer blends with, for instance, vinyl aromatic group polymers with atactic structures, vinyl aromatic group polymers with isotactic structures, and any other polymers that are miscible with the vinyl aromatic polymers. For example, polyphenylene ethers show good miscibility with many of the previous described vinyl aromatic group polymers.

When a polarizing film is made using a process with predominantly uniaxial stretching, particularly preferred combinations of polymers for optical layers include PEN/coPEN, PET/coPET, PEN/sPS, PET/sPS, PEN/"ESTAR," and PET/"ESTAR," where "coPEN" refers to a copolymer or blend based upon naphthalene dicarboxylic acid (as described above) and "ESTAR" refers to is a polyester or copolyester (believed to comprise cyclohexanedimethylene diol units and terephthalate units) commercially available under the trade designation "ESTAR" from Eastman Chemical Co. When a polarizing film is to be made by manipulating the process conditions of a biaxial stretching process, particularly preferred combinations of polymers for optical layers include PEN/coPEN, PEN/PET, PEN/PBT, PEN/PETG and PEN/PETcoPBT, where "PBT" refers to polybutylene terephthalate, "PETG" refers to a copolymer of PET employing a second glycol (usually cyclohexanedimethanol), and "PETcoPBT" refers to a copolyester of terephthalic acid or an ester thereof with a mixture of ethylene glycol and 1,4-butanediol.

Particularly preferred combinations of polymers for optical layers in the case of mirrors or colored films include PEN/PMMA, PET/PMMA, PEN/"ECDEL," PET/"ECDEL," PEN/sPS, PET/sPS, PEN/coPET, PEN/PETG, and PEN/ "THV," where "PMMA" refers to polymethyl methacrylate, "ECDEL" refers to a thermoplastic polyester or copolyester (believed to comprise cyclohexanedicarboxylate units, polytetramethylene ether glycol units, and cyclohexanedimethanol units) commercially available under the trade designation "ECDEL" from Eastman Chemical Co., "coPET" refers to a copolymer or blend based upon terephthalic acid (as described above), "PETG" refers to a copolymer of PET employing a second glycol (usually cyclohexanedimethanol), and "THV" is a fluoropolymer commercially available under the trade designation "THV" from the 3M Company.

It is sometimes preferred for the multilayer optical films of the current invention to consist of more than two distinguishable polymers. A third or subsequent polymer might be fruitfully employed as an adhesion-promoting layer between the first polymer and the second polymer within an optical stack, as an additional component in a stack for optical purposes, as a protective boundary layer between optical stacks, as a skin layer, as a functional coating, or for any other purpose. As such, the composition of a third or subsequent polymer, if any, is not limited. Preferred multicomponent constructions are described in copending application having U.S. Ser. No. 09/006,118, filed Jan. 13, 1998 the disclosure of which is incorporated by reference.

Detailed process considerations and additional layers are included in copending application having U.S. Ser. No. 09/006,288, filed Jan. 13, 1998, the disclosure of which is incorporated by reference. Further, additional details regarding optical films are described in applications having U.S. Ser. Nos. 08/402,041, filed Mar. 10, 1995; 08/494,366, filed Jun. 26, 1995; and 09/006,601 filed Jan. 13, 1998, the disclosures of which are incorporated herein by reference.

Widths of the color shifting film can vary as desired, and for many embodiments, according to the present invention, range from about 0.2 mm (8 mil) to about 5 mm, typically from about 1.6 mm (0.0625 in) to about 3 mm (0.125 in), although other widths may also be useful.

Preferably, the color shifting film reflects and transmits light over a wide bandwidth such that when lit, the plurality of sections of color shifting film appear brightly colored. In one embodiment according to the present invention, the hand-holdable novelty article includes a plurality of sections of non-color shifting film or other material (e.g., paper) interspaced with the plurality of sections of color shifting film.

Referring to FIG. 1, each of plurality of sections of color shifting film 16 are preferably each a strand having first, proximal end 26, intermediate portion 28 and second, distal end 30. In one preferred embodiment, plurality of sections of color shifting film 16 includes at least twenty strands. Proximal end 26 is configured for attachment to end 22 of handle 12. Intermediate portion 28 extends from proximal end 26 and is preferably constructed to be flexible. Distal end 30 is unattached or free. Thus, each of plurality of sections of color shifting film 16 is configured such that intermediate portion 28 can bend or curve. In one preferred embodiment, the color shifting film is configured such that when curved, intermediate portion 28 exhibits at least two different colors (e.g., green in transmission at normal incidence and pink (or magenta) in transmission at oblique angles). That is one portion of and/or some intermediate portion 28 are one color, and others a different (optically discernable) color when viewed from the same location or position. Plurality of sections of color shifting film 16 are preferably cut from a single sheet of color shifting film.

Hand-holdable novelty article 10 of one preferred embodiment can be constructed as follows. Light source 14 is disposed at or near end 22 of handle 12 when light source 14 and handle 12 are a flashlight. Proximal end 26 of each of plurality of sections of color shifting film 16 is attached to end 22 of handle 12. In one preferred embodiment, each of plurality of sections of color shifting film 16 is of a similar length. Proximal ends 26 of each of plurality of sections of color shifting film 16 are attached to end 22 of handle 12 by an adhesive material (e.g., adhesive tape). Alternatively, other ways of attachment are also useful (e.g., a liquid adhesive material).

During use, light source 14 in one preferred embodiment is activated by rotating second end 22 of handle 12 relative to body 18, although other ways of adding light source 14 (e.g., a separate switch) are also useful. Once lit, light from light source 14 is directed through leading edge 24 of handle 12 on to plurality of sections of color shifting film 16.

The visual appearance of the article according to the present invention may be enhanced, for example, by including at least two different color shifting film materials. The visual appearance of the article according to the present invention also may be enhanced, for example, by the color shifting film being moved or and/or are curved. For example, where the hand-holdable novelty article is maintained in a stationary position, and a viewer changes position relative to the article, the viewer will perceive a change in color. Thus, the plurality of sections of color of selective film are preferably configured such that when viewed from a first location, the plurality of sections of color shifting film exhibit a first optical characteristic (e.g., a first color), and when viewed from a second location, the plurality of sections of color shifting film exhibit a second optical characteristic (e.g., a second color) different from the first optical characteristic. Alternatively, the plurality of sections of color shifting film themselves can be moved.

The handle of the article according to the present invention can be configured to be held by a user such that movement of the handle, in turn, imparts a motion onto plurality of sections of color shifting film, much like a pom-pon. Because distal ends (see, e.g., reference number 30 in FIG. 1) of each of the plurality of sections of color shifting film are unattached, the sections of color shifting film are free to move in all directions. Thus, manipulation of the handle results in movement and therefore a perceived change in color in a plurality of sections of the color shifting film by a stationary viewer.

Additionally, the handle can be maneuvered by a user to impart a wave-like curve in intermediate portion (see, e.g., reference number 28) of at least one of a plurality of sections of color shifting film. As previously described, the color shifting film is preferably configured such that when curved, an optical characteristic, such as color of an intermediate portion, changes. Typically, not all of the plurality of sections of color shifting film will curve in the same manner. Therefore, rapid movement of the handle by a user generally creates, particularly in the dark, a brilliant, multi-colored effect, visually resembling a sparkler.

Each of the plurality of sections of color shifting film is typically flexible so as to allow curvature over an intermediate portion. However, in some embodiments according to the present invention, each of the plurality of sections of color shifting film has a certain amount of rigidity (e.g., sections of the color shifting film 16 will preferably bend, but do not deform on impact). With this configuration, movement of the handle can result in contact between several of plurality of sections of color shifting film, producing an audible sound. When the handle is vigorously shaken, numerous contacts can be made, producing a "hissing" sound, closely resembling a burning sparkler. Thus, preferred hand-holdable novelty articles according to the present invention can be similar in both sight and sound to a conventional burning sparkler. Such a hand-holdable novelty article according to the present invention does not have the "burning/fire" associated with a conventional sparkler.

The visual appearance of plurality of sections of color shifting film can be altered, for example, by including a translucent filter at leading edge of the handle (see, e.g., leading edge 24 of handle 12 in FIG. 1). The filter can alter the wavelengths of the light emitted by the light source varying the color(s) or colors produced by the plurality of sections of color shifting film. Optionally, the filter is or includes color shifting film.

Figure 1A:
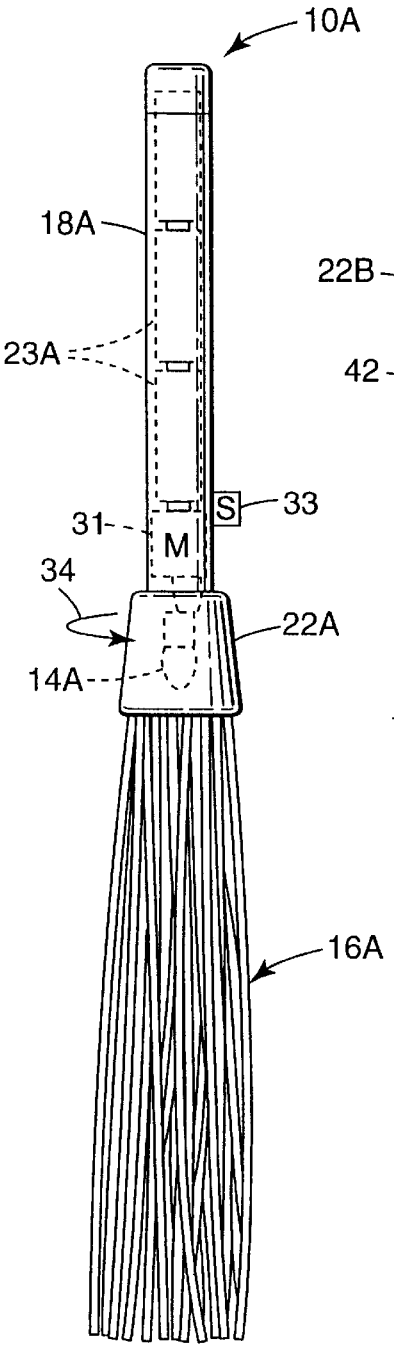
FIG. 1A is a side view of another hand-holdable novelty article according to the present invention.

Motion may be imparted to plurality of sections of color shifting film 16 using alternative means. Referring to FIG. 1A, one exemplary embodiment of a hand-holdable novelty device according to the present invention 10A is shown, which is similar to device 10 of FIG. 1, but which employs a mechanism 31 (e.g., a motor as shown) for imparting motion to color shifting film 16A.

Mechanism 31 is electrically coupled to power source 23A through switch mechanism 33, and mechanically coupled to end 22A. End 22A is rotatably coupled to body 18A. Upon operation of switch mechanism 33, mechanism 31 can be selectively energized for rotation of end 22A relative to body 18A (indicated by rotational arrow 34), about a central axis as defined by longitudinally extending body 18A. Rotation of end 22A at a desired speed will impart a desired amount of motion to color shifting film 16A. Further, switch mechanism 33 can be used for selective energization of light source 14A.

Figure 2:
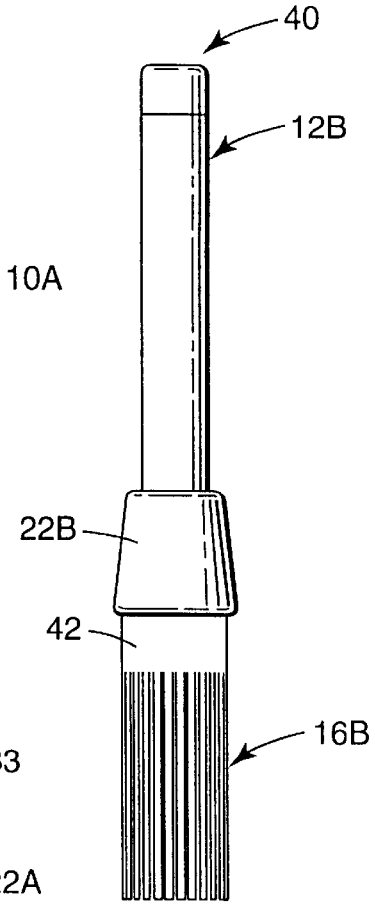
FIG. 2 is a side view of another hand-holdable novelty article according to the present invention.

In some embodiments according to the present invention (see, e.g., FIG. 1), the plurality of sections of color shifting film are attached directly to an end of the handle. Other forms of attachment are also useful. For example, FIG. 2 illustrates an alternative embodiment of hand-holdable novelty article according to the present invention 40, which is similar to device 10 shown in FIG. 1. Article 40 includes handle 12B, light source (not shown), plurality of sections of color shifting film 16B, and attachment body 42 for connecting plurality of sections of color shifting film 16B to end 22B of handle 12B. Although attachment body 42 is shown as a band of color shifting film integrally formed with plurality of sections of color shifting film 16B, it may be in other suitable forms such as a conical shell, or a multiple curved shell in the shape of a partial donut. With respect to the form shown, during manufacture, an appropriately sized sheet of color shifting film can be cut to provide plurality of sections 16B and band 42. Band 42 can be attached to end 22B of handle 12B, so that plurality of sections of color shifting film 16B extend therefrom, thus, plurality of sections 16B and attachment body 42 are thereby integral. Alternatively, for example, attachment body 42 can be an independently manufactured article, such as a strip of material attached at opposite ends to end 22B of handle 12B and plurality of sections of color shifting film 16B.

Regardless of exact form, attachment body 42 connects plurality of sections of color shifting film 16B to handle 12B while allowing light from light source 14B to interact with plurality of sections 16B. In this regard, attachment body 42 can be tubular in form, or may be a solid article configured to allow passage of light from the light source.

Figure 3:
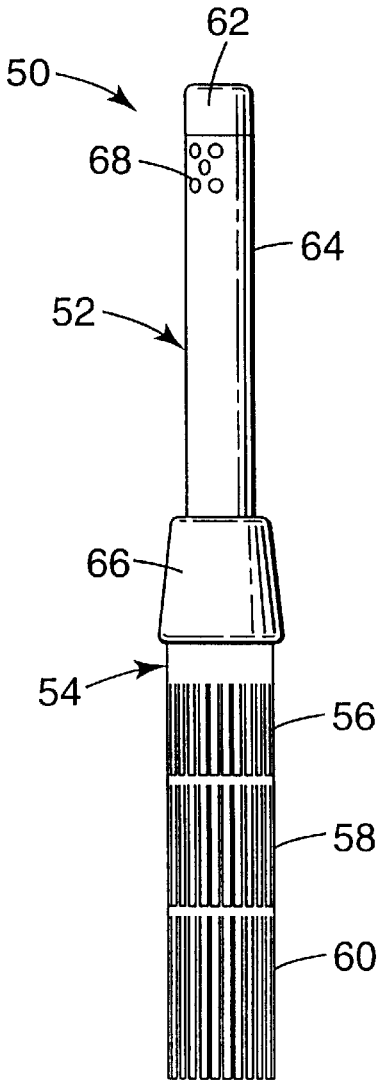
FIG. 3 is a side view of another hand-holdable novelty article according to the present invention.

Another embodiment of a hand-holdable novelty article according to the present invention is shown in FIG. 3. Hand-holdable novelty article 50 includes handle 52, light source (not shown), attachment body 54, first plurality of strands 56, second plurality of strands 58 and third plurality of strands 60. As with previous embodiments, handle 52 includes end 62, body 64 and end 66. Light source (not shown) is disposed within end 66. Further, the first, second and third plurality of strands 56, 58, 60, respectively, are connected to end 66 of handle 52 via attachment body 54.

Each of first, second and third plurality of strands 56, 58, 60 are preferably made of color shifting film. However, first, second, and third plurality of strands 56, 58, 60 are of varying lengths. Additionally, first, second and third plurality of strands 56, 58, 60 can be made of varying types of color shifting film such that during use, a wider variety of colors are displayed. Alternatively, at least one of first, second, or third plurality of strands 56, 58, or 60 can be non-color shifting film.

In addition to providing variable length strands of color shifting film, hand-holdable novelty article 50 optionally includes sound device 68 disposed in and/or on handle 52. Sound device 68 is preferably a speaker configured to produce a sound such as a siren. Alternatively, sound device 68 can be or include a radio. Sound device 68 is preferably electrically coupled to power source (not shown) and further enhances the performance of hand-holdable novelty article 50.

Figure 4:
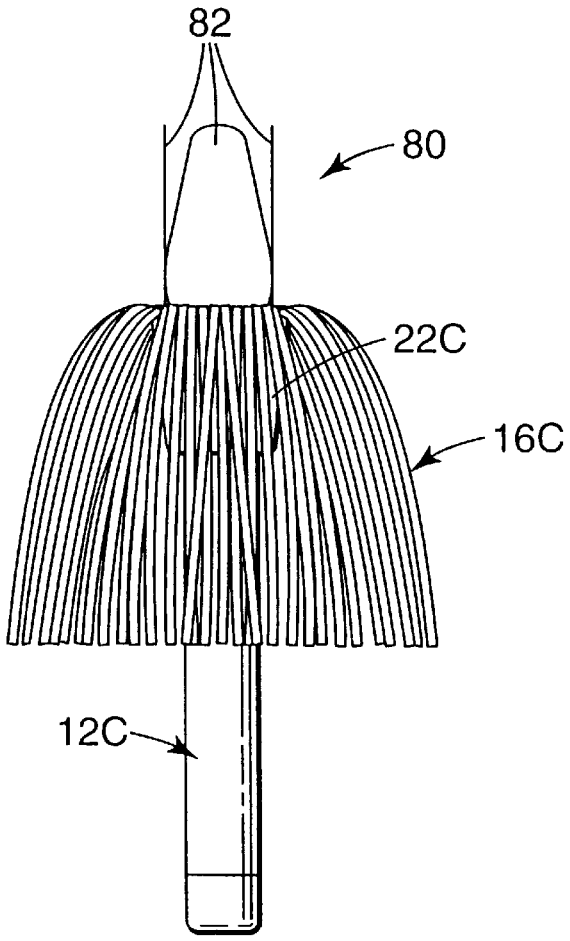
FIG. 4 is a side view of another hand-holdable novelty article according to the present invention.

In yet another embodiment of a hand-holdable novelty article according to the present invention shown in FIG. 4, article 80, which is similar to article 10 shown in FIG. 1, includes handle 12C, light source (not shown), fins 82, and plurality of sections of color shifting film 16C extending from end 22C of handle 12C. Fins 82 are preferably made of color shifting film and extend from end 22C of handle 12C. One preferred embodiment includes four fins 82, however, a greater or lesser number can also be used, depending, for example, on the desired effect. Fins 82 are preferably more rigid than plurality of sections of color shifting film 16C such that when handle 12C is oriented in an upright position (shown in FIG. 4), fins 82 likewise remain upright. Conversely, plurality of sections of color shifting film 16C are preferably flexible such that they curve downwardly when handle 12C is positioned upright. In the upright position, fins 82 preferably exhibit a candle-like appearance in response to light from a light source (not shown).

While the plurality of sections of color shifting film has been described as being flexible strands, other forms are also useful. For example, referring to FIG. 5, hand-holdable novelty article according to the present invention 90 has a flower-like appearance. Hand-holdable article 90 includes handle 92, light source 94, and plurality of sections of color shifting film 96.

Handle 92 and light source 94 preferably function similar to handle 12 and light source 14 of FIG. 1. In this regard, handle 92 includes end 98, body 100 having an outer circumference and end 102. Plurality of sections of color shifting film 96 extend from end 102 of handle 92. End 102 is rotatable relative to body 100 to control activation of light source 94. Alternatively, an external switch can be provided.

Figure 5:
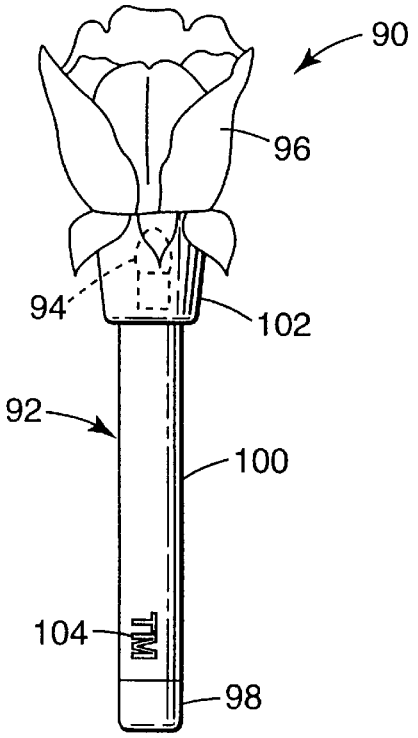
FIG. 5 is a side view of another hand-holdable novelty article according to the present invention.

In FIG. 5, plurality of sections of color shifting film 96 are configured to form a flower or flower-like shape. In this regard, each of plurality of sections of color shifting film 96 is rigid so as to maintain the preferred flower-like shape regardless of handle 92 position or movement. Each of plurality of sections of color shifting film 96 includes a curved surface to enhance visual appearance in response to light from light source 94 when activated. As such, color shifting film 96 reflects light from inside the flower-like shape, and reflects light from an outside surface of the flower-like shape. As previously described, a preferred color shifting film exhibits at least two different colors along each curved surface. In an alternative embodiment, sections of non-color shifting material (e.g., a film) can be interposed with plurality of sections of color shifting film 96.

Additionally, hand-holdable novelty article 90 includes optional indicia 104 (which may be, for example, a (U.S.) federally registered trademark) on outer circumference of handle body 100. Alternatively, the indicia can be in the form of a trademark or copyrighted material, including a registered trademark or registered copyright as defined under any of the countries, territories, etc. of the world (including the United States).

Figure 6A:
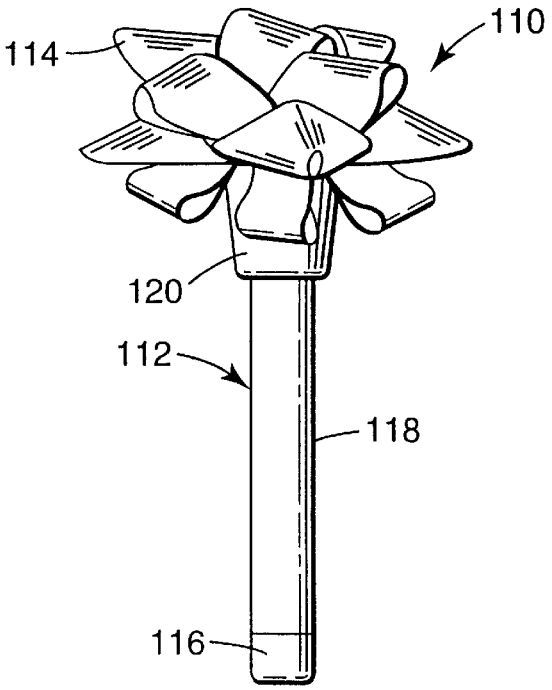
FIG. 6A is a side view of another hand-holdable novelty article according to the present invention.
Figure 6B:
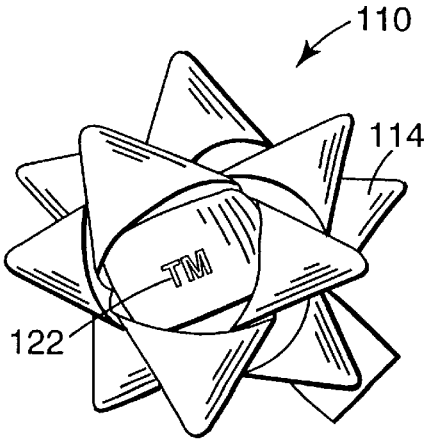
FIG. 6B is a top view of the novelty article of FIG. 6A.

Another embodiment of a hand-holdable novelty article according to the present invention is shown in FIGS. 6A and 6B. As with previous embodiments, hand-holdable novelty article 110 includes handle 112, light source (not shown) and plurality of sections of color shifting film 114. Handle 112 includes end 116, body 118 and end 120. Light source (not shown) is disposed within end 120 of handle 112, which additionally functions as a switch in the preferred embodiment. Thus, rotational movement of end 120 relative to body 118 controls activation of light source. Further, plurality of sections of color shifting film 114 are attached to end 120 of handle 112.

Unlike plurality of sections of color shifting film 16 previously described with reference to FIG. 1, both ends of each of plurality of sections of color shifting film 114 of FIGS. 6A and 6B are attached to end 120 of handle 112. Further, each of plurality of sections of color shifting film 114 have an increased width. As shown in FIGS. 6A and 6B, each of plurality of sections of color shifting film 114 are curved to form a bow. In one preferred embodiment, each of plurality of sections of color shifting film 114 includes multiple curvatures. As previously described, preferred color shifting film exhibits at least two different colors along a curved surface. Thus, the bow-shape of plurality of sections of color shifting film 114 enhances the overall appearance of hand-holdable novelty article 110 when the light source (not shown) is lit.

Further, as shown in FIG. 6B, at least one of plurality of sections of color shifting film 114 includes optional indicia 122 (which can be, for example, a (U.S.) federally registered trademark). Alternatively, the indicia can be in the form of a trademark of copyrightable material, including a registered trademark or registered copyright as defined under any of the laws of the countries, territories, etc. of the world (including the United States). In another respect, plurality of sections of color shifting film 114 can be configured to assume a shape representative of a trademark (including a federally registered trademark) and/or copyrightable material.

Figure 7:
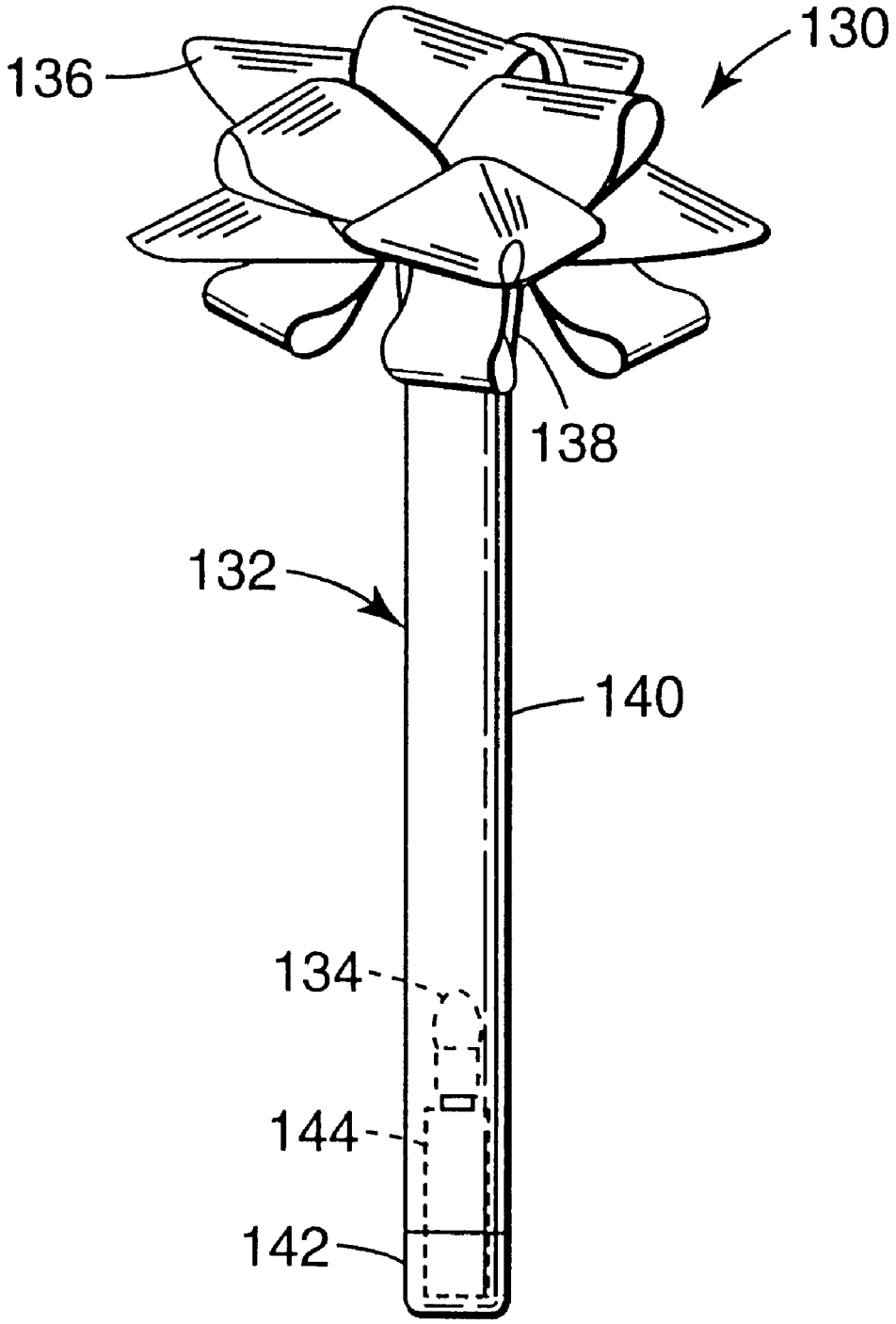
FIG. 7 is a side view of another hand-holdable novelty article according to the present invention.

Yet another embodiment of a hand-holdable novelty article according to the present invention is shown in FIG. 7. Hand-holdable novelty article 130 includes handle 132, light source 134, and plurality of sections of color shifting film 136. Handle 132 includes end 138, body 140 and end 142. Plurality of sections of color shifting film 136 are attached to end 138 of handle 132. Unlike previous embodiments, light source 134 is connected to handle 132, near end 142. Light source 134 is thereby connected to handle 132 away from end 138 to which plurality of sections of color shifting film 136 are attached. Light source 134 is preferably configured to be powered by power source 144 (e.g., battery shown in dashed lines). While the light source is described as being connected to the handle, it is understood that the light source can be connected directly to the handle, or alternatively, connected to the handle via any intermediate structure or elements.

Handle 132 is configured to transmit light from light source 134 to end 138 at which plurality of sections of color shifting film 136 are attached. Whatever the arrangement, the article is configured so that the light source illuminates at least a portion of the color shifting film. In this regard, light from light source 134 can be transmitted by, for example, a visible mirror film lining an interior of handle 132. Alternatively, for example, handle 132 can be a light fiber or a light tube. Even further, for example, a portion of handle 132 may include a partially reflective/partially transmissive film that directs some light to plurality of sections of color shifting film 136 and allows some light to pass through the film, such that handle 132 appears to be glowing or brightly colored when light source 134 is activated. Notably, a device for transmitting light from light source 134 to a region adjacent plurality of sections of color shifting film 136 can be separate from, or integral with, handle 132, or can simply be the handle itself.

Hand-holdable novelty articles according to the present invention provides an alternative to conventional sparklers. By incorporating a plurality of sections of color shifting film in conjunction with a light source, a brilliant, multi-colored novelty article can be provided.

Many adhesive materials may be used to laminate optical films and devices to another film, surface, or substrate. Such adhesive materials include pressure sensitive adhesives, hot-melt adhesives, solvent-coated adhesives, heat activated adhesives and the like. These adhesive materials preferably are optically clear, diffuse and exhibit non-hazy and non-whitening aging characteristics. Furthermore, the adhesive materials should exhibit long term stability under high heat and humidity conditions. Suitable adhesive materials may include solvent, heat, or radiation activated adhesive systems. Pressure sensitive adhesive materials are normally tacky at room temperature and can be adhered to a surface by application of light to moderate pressure.

Examples of adhesive materials, whether pressure sensitive or not and useful in the present invention include those based on general compositions of polyacrylate; polyvinyl ether; diene-containing rubbers such as natural rubber, polyisoprene, and polyisobutylene; polychloroprene; butyl rubber; butadiene-acrylonitrile polymers; thermoplastic elastomers; block copolymers such as styrene-isoprene and styrene-isoprene-styrene block copolymers, ethylene-propylene-diene polymers, and styrene-butadiene polymers; polyalphaolefins; amorphous polyolefins; silicone; ethylene-containing copolymers such as ethylene vinyl acetate, ethylacrylate, and ethylmethacrylate; polyurethanes; polyamides; polyesters; epoxies; polyvinylpyrrolidone and vinylpyrrolidone copolymers; and mixtures of the above.

Additionally, adhesive materials can contain additives such as tackifiers, plasticizers, fillers, antioxidants, stabilizers, diffusing particles, curatives, and solvents, provided they do not interfere with the optical characteristics of the devices. When additives are used they are used in quantities that are consistent with their intended use and when used to laminate an optical film to another surface, the adhesive composition and thickness are preferably selected so as not to interfere with the optical properties of the optical film. For example, when laminating additional layers to an optical film or device wherein a high degree of transmission is desired, the laminating adhesive material should be optically clear in the wavelength region that the film or device is designed to be transparent in.

Further, the surface(s) on which an adhesive material is applied or otherwise attached to may be primed (e.g., chemically, physical (e.g., physical treatment such as roughening), and corona) to affect the degree of attachment between the adhesive material and surface.

Components of toys according to the present invention can be made of any of a variety of materials (including those referred to herein). For example, suitable materials may include non-metallic (e.g., rigid or non-rigid polymeric materials) or metallic materials. Other suitable materials may also be apparent to those skilled in the art after reviewing the disclosure of the present invention.

The following two examples illustrate exemplary embodiments of the manufacture of color shifting films. Particular materials and amounts thereof recited in these examples, as well as other conditions and details, should not be construed to unduly limit this invention. All parts and percentages are by weight unless otherwise indicated.

EXAMPLE 1

The following example illustrates the preparation of a color shifting film.

A co-extruded film containing 209 layers was made on a sequential flat-film making line via a co-extrusion process. This multilayer polymer film was made from polyethylene naphthalate (PEN) and polymethyl methacrylate (PMMA CP82) where PEN was the outer layers or "skin" layers. A feedblock method (such as that described by U.S. Pat. No. 3,801,429) was used to generate about 209 layers which were co-extruded onto a water chilled casting wheel and continuously oriented by conventional sequential length orienter (LO) and tenter equipment. PEN with an intrinsic viscosity (IV) of 0.56 dl/g (60 wt. % phenol/40 wt. % dichlorobenzene) was delivered to the feedblock by one extruder at a rate of 60.5 kg/hr and the PMMA was delivered by another extruder at a rate of 63.2 Kg/hr. These melt streams were directed to the feedblock to create the PEN and PMMA optical layers. The feedblock created 209 alternating layers of PEN and PMMA with the two outside layers of PEN serving as the protective boundary layers (PBL's) through the feedblock. The PMMA melt process equipment was maintained at about 249° C.; the PEN melt process equipment was maintained at about 290° C.; and the feedblock, skin-layer modules, and die were also maintained at about 290° C.

An approximately linear gradient in layer thickness was designed for the feedblock for each material, with the ratio of thickest to thinnest layers being about 1.72:1. This hardware design of first-to-last layer thickness ratio of 1.73:1 was too great to make the bandwidth desired for the colored mirror of this example. In addition, a sloping blue band edge resulted from the as-designed hardware. To correct these problems, a temperature profile was applied to the feedblock. Selected layers created by the feedblock can be made thicker or thinner by warming or cooling the section of the feedblock where they are created. This technique was required to produce an acceptable sharp band edge on the blue side of the reflection band. The portion of the feedblock making the thinnest layers was heated to 304° C., while the portion making the thickest layers was heated to 274° C. Portions intermediate were heated between these temperature extremes. The overall effect is a much narrower layer thickness distribution which results in a narrower reflectance spectrum.

After the feedblock, a third extruder delivered a 50/50 blend of 0.56 dl/g IV and 0.48 dl/g IV PEN as skin layers (same thickness on both sides of the optical layer stream) at about 37.3 Kg/hr. By this method, the skin layers were of a lower viscosity than the optics layers, resulting in a stable laminar melt flow of the co-extruded layers. Then the material stream passed through a film die and onto a water cooled casting wheel using an inlet water temperature of about 7° C. A high voltage pinning system was used to pin the extrudate to the casting wheel. The pinning wire was about 0.17 mm thick and a voltage of about 5.5 kV was applied. The pinning wire was positioned manually by an operator about 3–5 mm from the web at the point of contact to the casting wheel to obtain a smooth appearance to the cast web.

The cast web was length oriented with a draw ratio of about 3.8:1 at about 130° C. In the tenter, the film was preheated before drawing to about 138° C. in about 9 seconds and then drawn in the transverse direction at about 140° C. to a draw ratio of about 5:1, at a rate of about 60% per second. The finished film had a final thickness of about 0.02 mm.

Figure 8:
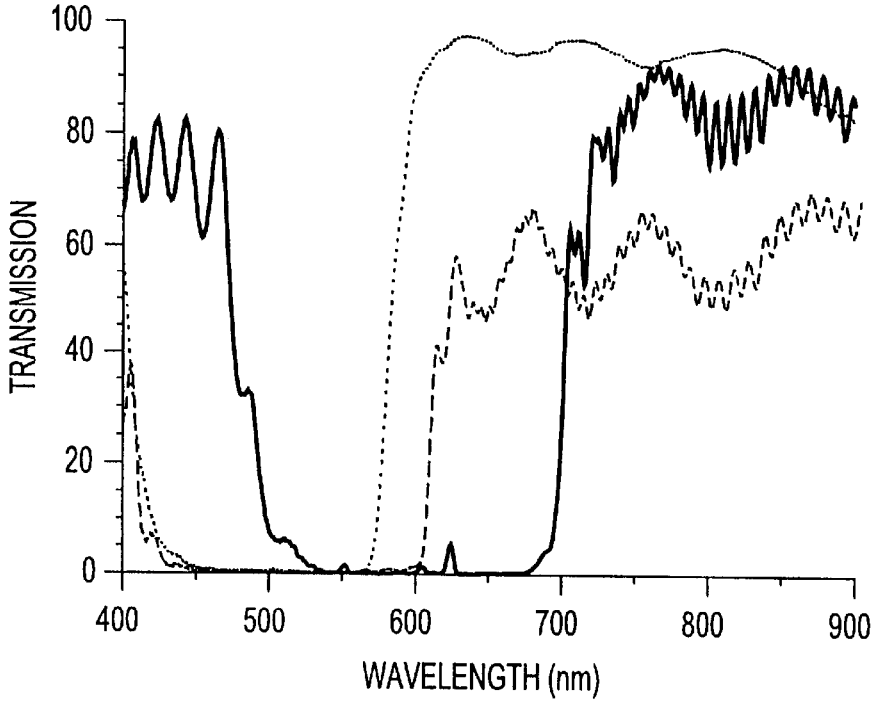
FIGS. 8 and 9 are optical spectra of two color shifting films.

The optical spectra for the film of this example are shown in FIG. 8. The film exhibited blue in transmission at normal incidence; yellow in reflection at normal incidence; red in transmission at oblique angles; and cyan in reflection at oblique angles.

EXAMPLE 2

The following example illustrates the preparation of a another color shifting film.

A multilayer film containing about 418 layers was made on a sequential flat-film making line via a co-extrusion process. This multilayer polymer film was made PET and polyester resin (available under the trade designation "ECDEL 9967" from Eastman Chemical Co. of Rochester, N.Y.) where PET was the outer layers or "skin" layers. A feedblock method (such as that described by U.S. Pat. No. 3,801,429) was used to generate about 209 layers with an approximately linear layer thickness gradient from layer to layer through the extrudate.

The PET, with an Intrinsic Viscosity (IV) of 0.56 dl/g was pumped to the feedblock at a rate of about 34.5 Kg/hr and the polyester resin ("ECDEL 9967") at about 41 Kg/hr. After the feedblock, the same PET extruder delivered PET as protective boundary layers (PBL's), to both sides of the extrudate at about 6.8 Kg/hr total flow. The material stream then passed though an asymmetric two times multiplier (U.S. Pat. Nos. 5,094,788 and 5,094,793) with a multiplier ratio of about 1.40. The multiplier ratio is defined as the average layer thickness of layers produced in the major conduit divided by the average layer thickness of layers in the minor conduit. This multiplier ratio was chosen so as to leave a spectral gap between the two reflectance bands created by the two sets of 209 layers. Each set of 209 layers has the approximate layer thickness profile created by the feedblock, with overall thickness scale factors determined by the multiplier and film extrusion rates.

The melt process equipment for the polyester resin ("ECDEL 9967") was maintained at about 250° C., the PET (optics layers) melt process equipment was maintained at about 265° C., and the feedblock, multiplier, skin-layer melt stream, and die were maintained at about 274° C.

The feedblock used to make the film for this example was designed to give a linear layer thickness distribution with a 1.3:1 ratio of thickest to thinnest layers under isothermal conditions. To achieve a smaller ratio for this example, a thermal profile was applied to the feedblock. The portion of the feedblock making the thinnest layers was heated to 285° C., while the portion making the thickest layers was heated to 265° C. In this manner the thinnest layers are made thicker than with isothermal feedblock operation, and the thickest layers are made thinner than under isothermal operation. Portions intermediate were set to follow a linear temperature profile between these two extremes. The overall effect is a narrower layer thickness distribution which results in a narrower reflectance spectrum. Some layer thickness errors are introduced by the multipliers, and account for the minor differences in the spectral features of each reflectance band. The casting wheel speed was adjusted for precise control of final film thickness, and therefore, final color.

After the multiplier, a thick symmetric PBL (skin layers) was added at about 28 Kg/hour that was fed from a third extruder. Then the material stream passed through a film die and onto a water cooled casting wheel. The inlet water temperature on the casting wheel was about 7° C. A high voltage pinning system was used to pin the extrudate to the casting wheel. The pinning wire was about 0.17 mm thick and a voltage of about 5.5 kV was applied. The pinning wire was positioned manually by an operator about 3–5 mm from the web at the point of contact to the casting wheel to obtain a smooth appearance to the cast web. The cast web was continuously oriented by conventional sequential length orienter (LO) and tenter equipment. The web was length oriented to a draw ratio of about 3.3 at about 100° C. The film was preheated to about 100° C. in about 22 seconds in the tenter and drawn in the transverse direction to a draw ratio of about 3.5 at a rate of about 20% per second. The finished film had a final thickness of about 0.05 mm.

Figure 9:
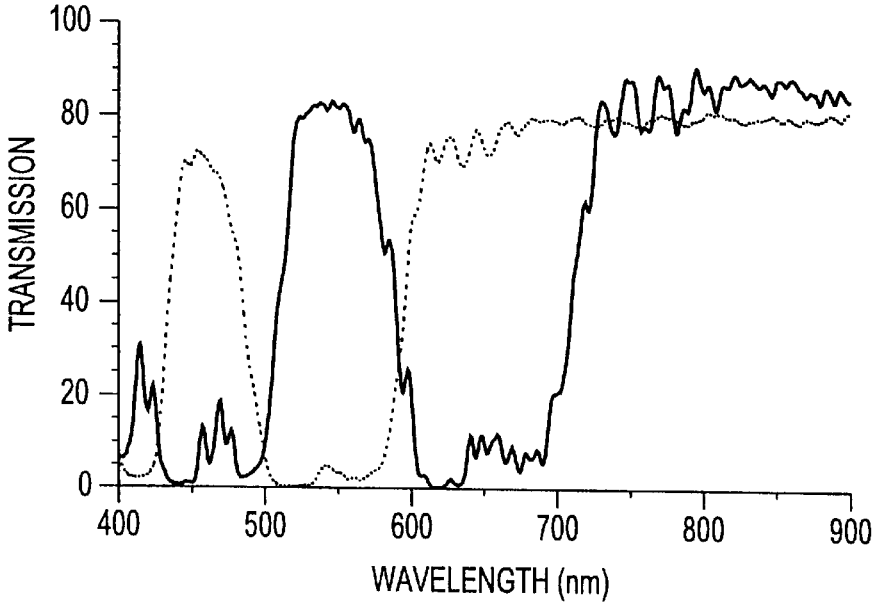

The optical spectra for the film of this example are shown in FIG. 9. The film exhibited green in transmission at normal incidence; magenta in reflection at normal incidence; magenta in transmission at oblique angles; and green in reflection at oblique angles.

It is to be noted that many different colors can be, for example, produced by modifying one or more parameters of the procedures described in Examples 1–2. Thus, for example, within certain limitations, the speed of the casting wheel can be adjusted to result in relative thickening or thinning of the optical layers within the extruded web. This results in a shift of the reflectance band to a different wavelength, which changes the color of the resulting film at a given angle of incidence.

EXAMPLE 3

The following example illustrates the preparation of a visible mirror film.

A coextruded film containing 601 layers was made on a sequential flat-filmmaking line via a coextrusion process. A polyethylene naphthalate (PEN) with an intrinsic viscosity of 0.57 dl/g (60 wt %% phenol/40 wt % dichlorobenzene) was delivered by extruder A at a rate of 114 pounds per hour with 64 pounds per hour going to the feedblock and the rest going to skin layers described below. PMMA (CP-82 from ICI of Americas) was delivered by extruder B at a rate of 61 pounds per hour with all of it going to the feedblock. PEN was on skin layers of the feedblock. The feedblock method was used to generate 151 layers using the feedblock such as those described in U.S. Pat. No. 3,801,429, after the feedblock two symmetric skin were coextruded using extruder C metering about 30 pounds per hour of the same type of PEN delivered by extruder A. This extrudate passed through two multipliers producing an extrudate of about 601 layers. U.S. Pat. No. 3,565,985 describes similar coextrusion multipliers. The extrudate passed through another device that coextruded skin layers at a total rate of 50 pounds per hour of PEN from extruder A. The web was length oriented to draw ratio of about 3.2 with the web temperature at about 280° F. The film was subsequently preheated to about 310° F. in about 38 seconds and drawn in the transverse direction to a draw ratio of about 4.5 at a rate of about 11% per second. The film was then heat-set at 440° F. with no relaxation allowed. The finished film thickness was about 3 mil.

Various modifications and alterations of this invention will become apparent to those skilled in the art without departing from the scope and spirit of this invention, and it should be understood that this invention is not to be unduly limited to the illustrative embodiments set forth herein. For example, the sections of color shifting film can assume a wide variety of forms when attached to the handle in addition to the pom-pon, flower, and bow shown in the figures. Thus, the sections of color shifting film may be oriented in the shape of an animal or inanimate object.

What is claimed is:

1. A novelty article comprising:

a handle including an end;

a plurality of sections of color shifting film extending from said end; and a light source connected to said handle, wherein when activated, said light source illuminates at least a portion of said plurality of sections of color shifting film, wherein said color shifting film comprises alternating layers of at least a first and second polymeric material, wherein at least one of said first and second polymeric materials is birefringent, wherein the difference in indices of refraction of said first and second polymeric materials for visible light polarized along first and second axes in the plane of said layers is at least about 0.05, and wherein the difference in indices of refraction of said first and second polymeric materials for visible light polarized along a third axis mutually orthogonal to said first and second axes is less than about 0.05.

2. The novelty article of claim 1, further comprising:

a power source electrically coupled to said light source.

3. The novelty article of claim 2, wherein said power source is a battery.

4. The novelty article of claim 2, further comprising:

a switch operably connected between said power source and said light source for controlling activation of said light source.

5. The novelty article of claim 1, wherein said light source is proximate said end of said handle.

6. The novelty article of claim 1, wherein said light source is remote from said end of said handle, and said handle is configured to transmit light from said light source to at least a portion of said sections of color shifting film.

7. The novelty article of claim 1, wherein said light source is configured to emit visible light.

8. The novelty article of claim 7, wherein said light source is switchable between a powered state and an unpowered state, at least a portion of said plurality of sections of color shifting film being configured to exhibit a more brilliant color when said light source is in said powered state than in said unpowered state.

9. The novelty article of claim 7, further comprising:

a second plurality of sections extending from said first end of said handle, wherein said second plurality of sections is non-color shifting film.

10. The novelty article of claim 7, wherein at least a first portion of said plurality of sections is a first color shifting film and at least a second portion of said plurality of sections is a second color shifting film different from said first color shifting film.

11. The novelty article of claim 10, wherein at least a portion of said first and second color shifting films are configured such that when viewed from a fixed location, said portion of said first color shifting film exhibits a first color and said portion of said second color shifting film exhibits a second color different from said first color.

12. The novelty article of claim 7, further comprising:

an attachment body for connecting a portion of each of said plurality of sections of color shifting film to said end of said handle.

13. The novelty article of claim 7, wherein each of said plurality of sections of color shifting film is a strand having a proximal end attached to said end of said handle and a distal end extending therefrom.

14. The novelty article of claim 13, wherein said plurality of sections of color shifting film includes at least twenty strands of color shifting film.

15. The novelty article of claim 13, wherein each of said plurality of strands includes an intermediate portion between said proximal end and said distal end, and further wherein each of the plurality of strands is flexible such that in a first position, said intermediate portion is flat and in a second position said intermediate portion is curved.

16. The novelty article of claim 15, wherein each of said plurality of strands is configured such that movement of said handle moves each of said plurality of strands from said first position to said second position.

17. The novelty article of claim 7, wherein each of said plurality of sections is configured to be relatively rigid such that contact between said plurality of sections of color shifting film produces a sound.

18. The novelty article of claim 7, further comprising:

a sound device connected to said handle.

19. The novelty article of claim 7, wherein said plurality of sections of color shifting film are configured in the form of a flower.

20. The novelty article of claim 7, further comprising a filter disposed between said light source and said plurality of sections of color shifting film.

21. The novelty article of claim 7, wherein at least one of said plurality of sections of color shifting film exhibits a trademark indicia.

22. The novelty article of claim 7, wherein said plurality of sections of color shifting film form a trademark.

23. The novelty article of claim 7, wherein an outer surface of said handle displays a trademark indicia.

24. The novelty article of claim 7, wherein at least one of said plurality of sections of color shifting film exhibits a copyrightable material indicia.

25. The novelty article of claim 7, wherein said plurality of sections of color shifting film form copyrighted material.

26. The novelty article of claim 7, wherein an outer surface of said handle displays copyrighted material.

27. The novelty article of claim 7, wherein said light source comprises an incandescent lamp.

28. The novelty article of claim 7, wherein said light source comprises a black light lamp.

29. The novelty article of claim 7, wherein said light source comprises a halogen lamp.

30. A novelty article comprising:

a handle including an end;

a plurality of sections of color shifting film extending from said end; and a light source connected to said handle, wherein said plurality of sections of color shifting film are configured in the form of a bow, and wherein when activated, said light source illuminates at least a portion of said plurality of sections of color shifting film, wherein said color shifting film comprises alternating layers of at least a first and second polymeric material, wherein at least one of said first and second polymeric materials is birefringent, wherein the difference in indices of refraction of said first and second polymeric materials for visible light polarized along first and second axes in the plane of said layers is at least about 0.05, and wherein the difference in indices of refraction of said first and second polymeric materials for visible light polarized along a third axis mutually orthogonal to said first and second axes is less than about 0.05.

31. A pom-pon comprising:

a handle including an end;

a light source connected to said handle; and a plurality of strands of color shifting film extending from said end of said handle, a portion of each of said plurality of strands being in close proximity to said light source, wherein said color shifting film comprises alternating layers of at least a first and second polymeric material, wherein at least one of said first and second polymeric materials is birefringent, wherein the difference in indices of refraction of said first and second polymeric materials for visible light polarized along first and second axes in the plane of said layers is at least about 0.05, and wherein the difference in indices of refraction of said first and second polymeric materials for visible light polarized along a third axis mutually orthogonal to said first and second axes is less than about 0.05.

32. The pom-pon of claim 31, wherein each of said plurality of strands includes a first end attached to said handle, an intermediate portion and a second end, each of the plurality of strands being configured such that in a motion state, movement of said handle forces said intermediate portion to curve.

* * * * *